US010186184B2

(12) United States Patent
Kim

(10) Patent No.: US 10,186,184 B2
(45) Date of Patent: Jan. 22, 2019

(54) DISPLAY APPARATUS WITH IMAGE RETENTION COMPENSATION AND METHOD OF DRIVING DISPLAY PANEL USING THE SAME

(71) Applicant: SAMSUNG DISPLAY CO., LTD., Yongin-si, Gyeonggi-Do (KR)

(72) Inventor: Min-Weun Kim, Seoul (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 21 days.

(21) Appl. No.: 15/014,438

(22) Filed: Feb. 3, 2016

(65) Prior Publication Data

US 2016/0307492 A1 Oct. 20, 2016

(30) Foreign Application Priority Data

Apr. 17, 2015 (KR) ..... 10-2015-0054471

(51) Int. Cl.
*G09G 3/20* (2006.01)

(52) U.S. Cl.
CPC ..... *G09G 3/20* (2013.01); *G09G 3/2044* (2013.01); *G09G 2300/08* (2013.01); *G09G 2320/0247* (2013.01); *G09G 2340/16* (2013.01)

(58) Field of Classification Search
CPC ..... G09G 3/2044; G09G 3/2051; G09G 2320/0257; G09G 2320/0233; G09G 2340/16; G09G 2320/0247; G09G 2320/103; G09G 2320/0285
See application file for complete search history.

(56) References Cited

U.S. PATENT DOCUMENTS

2004/0125117 A1* 7/2004 Suzuki ..... G09G 3/2048 345/690
2010/0302287 A1* 12/2010 Katayama ..... G09G 3/3648 345/690
2013/0135932 A1* 5/2013 Lee ..... G11C 16/0483 365/185.12
2015/0009229 A1* 1/2015 Ji ..... G09G 5/02 345/601
2016/0042707 A1* 2/2016 Wang ..... G09G 3/2044 345/214

FOREIGN PATENT DOCUMENTS

KR 10-2007-0062836 A 6/2007
KR 10-2008-0080708 A 9/2008
KR 10-2009-0074861 A 7/2009
KR 10-2013-0109815 A 10/2013

* cited by examiner

*Primary Examiner* — Xuemei Zheng
(74) *Attorney, Agent, or Firm* — Lee & Morse, P.C.

(57) ABSTRACT

A display apparatus includes a display panel, a timing controller, and a data driver. The display panel includes subpixels for displaying images. The timing controller accumulates a count value when a same grayscale value repeats for one of the subpixels, determines a boundary portion of the image based on the accumulated count value, and generates a data signal to compensate the boundary portion. The data driver converts the data signal to a data voltage for the display panel.

18 Claims, 14 Drawing Sheets

FIG. 3

610

| | | | | | | | | | | | | | | |
|---|---|---|---|---|---|---|---|---|---|---|---|---|---|---|
| R11 | G11 | B11 | R21 | G21 | B21 | R31 | G31 | B31 | R41 | G41 | B41 | R51 | G51 | B51 |
| R12 | G12 | B12 | R22 | G22 | B22 | R32 | G32 | B32 | R42 | G42 | B42 | R52 | G52 | B52 |
| R13 | G13 | B13 | R23 | G23 | B23 | R33 | G33 | B33 | R43 | G43 | B43 | R53 | G53 | B53 |
| R14 | G14 | B14 | R24 | G24 | B24 | R34 | G34 | B34 | R44 | G44 | B44 | R54 | G54 | B54 |
| R15 | G15 | B15 | R25 | G25 | B25 | R35 | G35 | B35 | R45 | G45 | B45 | R55 | G55 | B55 |
| R16 | G16 | B16 | R26 | G26 | B26 | R36 | G36 | B36 | R46 | G46 | B46 | R56 | G56 | B56 |
| R17 | G17 | B17 | R27 | G27 | B27 | R37 | G37 | B37 | R47 | G47 | B47 | R57 | G57 | B57 |
| R18 | G18 | B18 | R28 | G28 | B28 | R38 | G38 | B38 | R48 | G48 | B48 | R58 | G58 | B58 |
| R19 | G19 | B19 | R29 | G29 | B29 | R39 | G39 | B39 | R49 | G49 | B49 | R59 | G59 | B59 |

FIG. 4

620

| | | | | | | | | | | | | | | |
|---|---|---|---|---|---|---|---|---|---|---|---|---|---|---|
| RN11 | GN11 | BN11 | RN21 | GN21 | BN21 | RN31 | GN31 | BN31 | RN41 | GN41 | BN41 | RN51 | GN51 | BN51 |
| RN12 | GN12 | BN12 | RN22 | GN22 | BN22 | RN32 | GN32 | BN32 | RN42 | GN42 | BN42 | RN52 | GN52 | BN52 |
| RN13 | GN13 | BN13 | RN23 | GN23 | BN23 | RN33 | GN33 | BN33 | RN43 | GN43 | BN43 | RN53 | GN53 | BN53 |
| RN14 | GN14 | BN14 | RN24 | GN24 | BN24 | RN34 | GN34 | BN34 | RN44 | GN44 | BN44 | RN54 | GN54 | BN54 |
| RN15 | GN15 | BN15 | RN25 | GN25 | BN25 | RN35 | GN35 | BN35 | RN45 | GN45 | BN45 | RN55 | GN55 | BN55 |
| RN16 | GN16 | BN16 | RN26 | GN26 | BN26 | RN36 | GN36 | BN36 | RN46 | GN46 | BN46 | RN56 | GN56 | BN56 |
| RN17 | GN17 | BN17 | RN27 | GN27 | BN27 | RN37 | GN37 | BN37 | RN47 | GN47 | BN47 | RN57 | GN57 | BN57 |
| RN18 | GN18 | BN18 | RN28 | GN28 | BN28 | RN38 | GN38 | BN38 | RN48 | GN48 | BN48 | RN58 | GN58 | BN58 |
| RN19 | GN19 | BN19 | RN29 | GN29 | BN29 | RN39 | GN39 | BN39 | RN49 | GN49 | BN49 | RN59 | GN59 | BN59 |

FIG. 5

630

| | | | | | | | | | | | | | | |
|---|---|---|---|---|---|---|---|---|---|---|---|---|---|---|
| RC11 | GC11 | BC11 | RC21 | GC21 | BC21 | RC31 | GC31 | BC31 | RC41 | GC41 | BC41 | RC51 | GC51 | BC51 |
| RC12 | GC12 | BC12 | RC22 | GC22 | BC22 | RC32 | GC32 | BC32 | RC42 | GC42 | BC42 | RC52 | GC52 | BC52 |
| RC13 | GC13 | BC13 | RC23 | GC23 | BC23 | RC33 | GC33 | BC33 | RC43 | GC43 | BC43 | RC53 | GC53 | BC53 |
| RC14 | GC14 | BC14 | RC24 | GC24 | BC24 | RC34 | GC34 | BC34 | RC44 | GC44 | BC44 | RC54 | GC54 | BC54 |
| RC15 | GC15 | BC15 | RC25 | GC25 | BC25 | RC35 | GC35 | BC35 | RC45 | GC45 | BC45 | RC55 | GC55 | BC55 |
| RC16 | GC16 | BC16 | RC26 | GC26 | BC26 | RC36 | GC36 | BC36 | RC46 | GC46 | BC46 | RC56 | GC56 | BC56 |
| RC17 | GC17 | BC17 | RC27 | GC27 | BC27 | RC37 | GC37 | BC37 | RC47 | GC47 | BC47 | RC57 | GC57 | BC57 |
| RC18 | GC18 | BC18 | RC28 | GC28 | BC28 | RC38 | GC38 | BC38 | RC48 | GC48 | BC48 | RC58 | GC58 | BC58 |
| RC19 | GC19 | BC19 | RC29 | GC29 | BC29 | RC39 | GC39 | BC39 | RC49 | GC49 | BC49 | RC59 | GC59 | BC59 |

FIG. 6A

610

| R1 | R2 | R3 | R4 | R5 | R6 | R7 | R8 | R9 | R10 | R11 | R12 | R13 | R14 | R15 |
|---|---|---|---|---|---|---|---|---|---|---|---|---|---|---|
| 0 | 0 | 0 | 0 | 0 | 255 | 255 | 255 | 255 | 255 | 0 | 0 | 0 | 0 | 0 |
| 0 | 0 | 0 | 0 | 0 | 255 | 255 | 255 | 255 | 255 | 0 | 0 | 0 | 0 | 0 |
| 0 | 0 | 0 | 0 | 0 | 255 | 255 | 255 | 255 | 255 | 0 | 0 | 0 | 0 | 0 |
| 0 | 0 | 0 | 0 | 0 | 255 | 255 | 255 | 255 | 255 | 0 | 0 | 0 | 0 | 0 |
| 0 | 0 | 0 | 0 | 0 | 255 | 255 | 255 | 255 | 255 | 0 | 0 | 0 | 0 | 0 |
| 0 | 0 | 0 | 0 | 0 | 255 | 255 | 255 | 255 | 255 | 0 | 0 | 0 | 0 | 0 |
| 0 | 0 | 0 | 0 | 0 | 255 | 255 | 255 | 255 | 255 | 0 | 0 | 0 | 0 | 0 |
| 0 | 0 | 0 | 0 | 0 | 255 | 255 | 255 | 255 | 255 | 0 | 0 | 0 | 0 | 0 |
| 0 | 0 | 0 | 0 | 0 | 255 | 255 | 255 | 255 | 255 | 0 | 0 | 0 | 0 | 0 |

FIG. 6B

610

| R1 | R2 | R3 | R4 | R5 | R6 | R7 | R8 | R9 | R10 | R11 | R12 | R13 | R14 | R15 |
|---|---|---|---|---|---|---|---|---|---|---|---|---|---|---|
| 127 | 127 | 127 | 127 | 127 | 127 | 127 | 127 | 127 | 127 | 127 | 127 | 127 | 127 | 127 |
| 127 | 127 | 127 | 127 | 127 | 127 | 127 | 127 | 127 | 127 | 127 | 127 | 127 | 127 | 127 |
| 127 | 127 | 127 | 127 | 127 | 127 | 127 | 127 | 127 | 127 | 127 | 127 | 127 | 127 | 127 |
| 127 | 127 | 127 | 127 | 127 | 127 | 127 | 127 | 127 | 127 | 127 | 127 | 127 | 127 | 127 |
| 127 | 127 | 127 | 127 | 127 | 127 | 127 | 127 | 127 | 127 | 127 | 127 | 127 | 127 | 127 |
| 127 | 127 | 127 | 127 | 127 | 127 | 127 | 127 | 127 | 127 | 127 | 127 | 127 | 127 | 127 |
| 127 | 127 | 127 | 127 | 127 | 127 | 127 | 127 | 127 | 127 | 127 | 127 | 127 | 127 | 127 |
| 127 | 127 | 127 | 127 | 127 | 127 | 127 | 127 | 127 | 127 | 127 | 127 | 127 | 127 | 127 |
| 127 | 127 | 127 | 127 | 127 | 127 | 127 | 127 | 127 | 127 | 127 | 127 | 127 | 127 | 127 |

FIG. 7

620

| RN1 | RN2 | RN3 | RN4 | RN5 | RN6 | RN7 | RN8 | RN9 | RN10 | RN11 | RN12 | RN13 | RN14 | RN15 |
|---|---|---|---|---|---|---|---|---|---|---|---|---|---|---|
| 0 | 0 | 0 | 0 | 0 | 5 | 5 | 5 | 5 | 5 | 0 | 0 | 0 | 0 | 0 |
| 0 | 0 | 0 | 0 | 0 | 5 | 5 | 5 | 5 | 5 | 0 | 0 | 0 | 0 | 0 |
| 0 | 0 | 0 | 0 | 0 | 5 | 5 | 5 | 5 | 5 | 0 | 0 | 0 | 0 | 0 |
| 0 | 0 | 0 | 0 | 0 | 5 | 5 | 5 | 5 | 5 | 0 | 0 | 0 | 0 | 0 |
| 0 | 0 | 0 | 0 | 0 | 5 | 5 | 5 | 5 | 5 | 0 | 0 | 0 | 0 | 0 |
| 0 | 0 | 0 | 0 | 0 | 5 | 5 | 5 | 5 | 5 | 0 | 0 | 0 | 0 | 0 |
| 0 | 0 | 0 | 0 | 0 | 5 | 5 | 5 | 5 | 5 | 0 | 0 | 0 | 0 | 0 |
| 0 | 0 | 0 | 0 | 0 | 5 | 5 | 5 | 5 | 5 | 0 | 0 | 0 | 0 | 0 |
| 0 | 0 | 0 | 0 | 0 | 5 | 5 | 5 | 5 | 5 | 0 | 0 | 0 | 0 | 0 |

FIG. 8

630

| RC1 | RC2 | RC3 | RC4 | RC5 | RC6 | RC7 | RC8 | RC9 | RC10 | RC11 | RC12 | RC13 | RC14 | RC15 |
|---|---|---|---|---|---|---|---|---|---|---|---|---|---|---|
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |

FIG. 10A

630

FRAME[N]

| RC1 | RC2 | RC3 | RC4 | RC5 | RC6 | RC7 | RC8 | RC9 | RC10 | RC11 | RC12 | RC13 | RC14 | RC15 |
|---|---|---|---|---|---|---|---|---|---|---|---|---|---|---|
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |

FIG. 10B

630

FRAME[N+1]

| RC1 | RC2 | RC3 | RC4 | RC5 | RC6 | RC7 | RC8 | RC9 | RC10 | RC11 | RC12 | RC13 | RC14 | RC15 |
|---|---|---|---|---|---|---|---|---|---|---|---|---|---|---|
| 0 | 0 | 0 | 2 | 1 | 1 | 2 | 0 | 2 | 1 | 1 | 2 | 0 | 0 | 0 |
| 0 | 0 | 0 | 2 | 1 | 1 | 2 | 0 | 2 | 1 | 1 | 2 | 0 | 0 | 0 |
| 0 | 0 | 0 | 2 | 1 | 1 | 2 | 0 | 2 | 1 | 1 | 2 | 0 | 0 | 0 |
| 0 | 0 | 0 | 2 | 1 | 1 | 2 | 0 | 2 | 1 | 1 | 2 | 0 | 0 | 0 |
| 0 | 0 | 0 | 2 | 1 | 1 | 2 | 0 | 2 | 1 | 1 | 2 | 0 | 0 | 0 |
| 0 | 0 | 0 | 2 | 1 | 1 | 2 | 0 | 2 | 1 | 1 | 2 | 0 | 0 | 0 |
| 0 | 0 | 0 | 2 | 1 | 1 | 2 | 0 | 2 | 1 | 1 | 2 | 0 | 0 | 0 |
| 0 | 0 | 0 | 2 | 1 | 1 | 2 | 0 | 2 | 1 | 1 | 2 | 0 | 0 | 0 |
| 0 | 0 | 0 | 2 | 1 | 1 | 2 | 0 | 2 | 1 | 1 | 2 | 0 | 0 | 0 |

FIG. 11

630

| RC1 | RC2 | RC3 | RC4 | RC5 | RC6 | RC7 | RC8 | RC9 | RC10 | RC11 | RC12 | RC13 | RC14 | RC15 |
|---|---|---|---|---|---|---|---|---|---|---|---|---|---|---|
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 1 | 1 | 1 | 2 | 3 | 3 | 2 | 1 | 2 | 3 | 3 | 2 | 1 | 1 | 1 |
| 2 | 2 | 2 | 3 | 4 | 4 | 3 | 2 | 3 | 4 | 4 | 3 | 2 | 2 | 2 |
| 2 | 2 | 2 | 3 | 4 | 4 | 3 | 2 | 3 | 4 | 4 | 3 | 2 | 2 | 2 |
| 1 | 1 | 1 | 2 | 3 | 3 | 2 | 1 | 2 | 3 | 3 | 2 | 1 | 1 | 1 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |

FIG. 12

630

| RC1 | RC2 | RC3 | RC4 | RC5 | RC6 | RC7 | RC8 | RC9 | RC10 | RC11 | RC12 | RC13 | RC14 | RC15 |
|---|---|---|---|---|---|---|---|---|---|---|---|---|---|---|
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| -1 | -1 | -1 | 0 | 1 | 1 | 0 | -1 | 0 | 1 | 1 | 0 | -1 | -1 | -1 |
| -2 | -2 | -2 | -1 | 0 | 0 | -1 | -2 | -1 | 0 | 0 | -1 | -2 | -2 | -2 |
| -2 | -2 | -2 | -1 | 0 | 0 | -1 | -2 | -1 | 0 | 0 | -1 | -2 | -2 | -2 |
| -1 | -1 | -1 | 0 | 1 | 1 | 0 | -1 | 0 | 1 | 1 | 0 | -1 | -1 | -1 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |
| 0 | 0 | 0 | 1 | 2 | 2 | 1 | 0 | 1 | 2 | 2 | 1 | 0 | 0 | 0 |

DISPLAY APPARATUS WITH IMAGE RETENTION COMPENSATION AND METHOD OF DRIVING DISPLAY PANEL USING THE SAME

BACKGROUND

1. Field

One or more embodiments described herein relate to a display apparatus and a method of driving a display panel.

2. Description of the Related Art

A display apparatus typically includes a display panel and a display panel driver. The display panel has gate lines and data lines connected to subpixels, and the display panel driver includes a timing controller, a gate driver, and a data driver. The gate driver outputs a gate signal to the gate line, and the data driver outputs data voltages to the data lines. The subpixels emit light with a luminance that is based on the data voltages.

Additionally, each subpixel may include a switching element in the form of a thin film transistor. When the thin film transistor repetitively turns on and off, a temporary image retention effect may be generated due to hysteresis. The temporary image retention effect may adversely affect the performance of the display panel.

SUMMARY

In accordance with one or more embodiments, a display apparatus includes a display panel including a plurality of subpixels to display an image; a timing controller to accumulate a count value when a same grayscale value repeats for one of the subpixels, determine a boundary portion of the image based on the accumulated count value, and generate a data signal to compensate the boundary portion; and a data driver to convert the data signal to a data voltage for the display panel.

The count value may increase as a time duration during which the same grayscale value repeats increases. The count value may increase as the repeating grayscale value increases. A time duration to compensate the boundary portion may increase as the accumulated count value increases.

When the count value increases to a maximum count value, the count value may not to be increased over the maximum count value, even when the same grayscale value repeats for the subpixel. The timing controller may include an image comparator to compare present frame data to previous frame data.

The display apparatus may include an image buffer to store the previous frame data in units of subpixels. The display apparatus may include a count buffer to store the count value in units of subpixels. The display apparatus may include a compensating buffer to store a boundary compensating value to compensate the boundary portion in units of subpixels.

When the boundary compensating value to compensate a boundary portion of a first region is written in the compensating buffer based on the accumulated count value, a portion of the count buffer corresponding to the first region may be reset. When plural compensating values exist at the subpixel of the compensating buffer, the plural compensating values may be summed.

The timing controller may generate varied compensating patterns for a same boundary portion on a frame basis. The timing controller may alternately generate positive boundary compensating values and negative boundary compensating values for plural boundary portions generated at different times. The boundary portion of the image may be independently determined based on colors of light to be emitted by the subpixels.

In accordance with one or more other embodiments, a method of driving a display panel includes accumulating a count value when a same grayscale value is repetitive at a subpixel of the display panel; determining a boundary portion of an image based on the accumulated count value and generating a boundary compensating value to compensate the boundary portion when the grayscale value of the subpixel stops repeating; and generating a data voltage based on input image data and the boundary compensating value and outputting the data voltage to the display panel.

The count value may increase as a time duration when the same grayscale value is repetitive increases. The count value may increase as the repeating grayscale value increases. A time duration to compensate the boundary portion may increase as the accumulated count value increases.

Generating the boundary compensating value may include generating varied compensating patterns for a same boundary portion on a frame basis. Generating the boundary compensating value may include alternately generating positive boundary compensating values and negative boundary compensating values for plural boundary portions which generated at different times.

BRIEF DESCRIPTION OF THE DRAWINGS

Features will become apparent to those of skill in the art by describing in detail exemplary embodiments with reference to the attached drawings in which:

FIG. 3 illustrates an embodiment of an image buffer;

FIG. 4 illustrates an embodiment of a count buffer;

FIG. 5 illustrates an embodiment of a compensating buffer;

FIG. 6A illustrates an example of a case where a stripe pattern of grayscale values is input to the image buffer of FIG. 3, and FIG. 6B illustrates an example of a case where a single color pattern is input to the image buffer of FIG. 3;

FIG. 7 illustrates an example where the count buffer stores accumulated count values for the input image of FIGS. 6A and 6B;

FIG. 8 illustrates an example where the compensating buffer stores a compensating value determined by the count value in the count buffer of FIG. 7;

FIG. 10A illustrates an example of the contents of a compensating buffer for an N-th frame, and FIG. 10B illustrates an example of the contents of the compensating buffer in an (N+1)-th frame;

FIG. 11 illustrates an example of the contents of a compensating buffer; and FIG. 12 illustrates another example of the contents of a compensating buffer.

DETAILED DESCRIPTION

Figure 1:
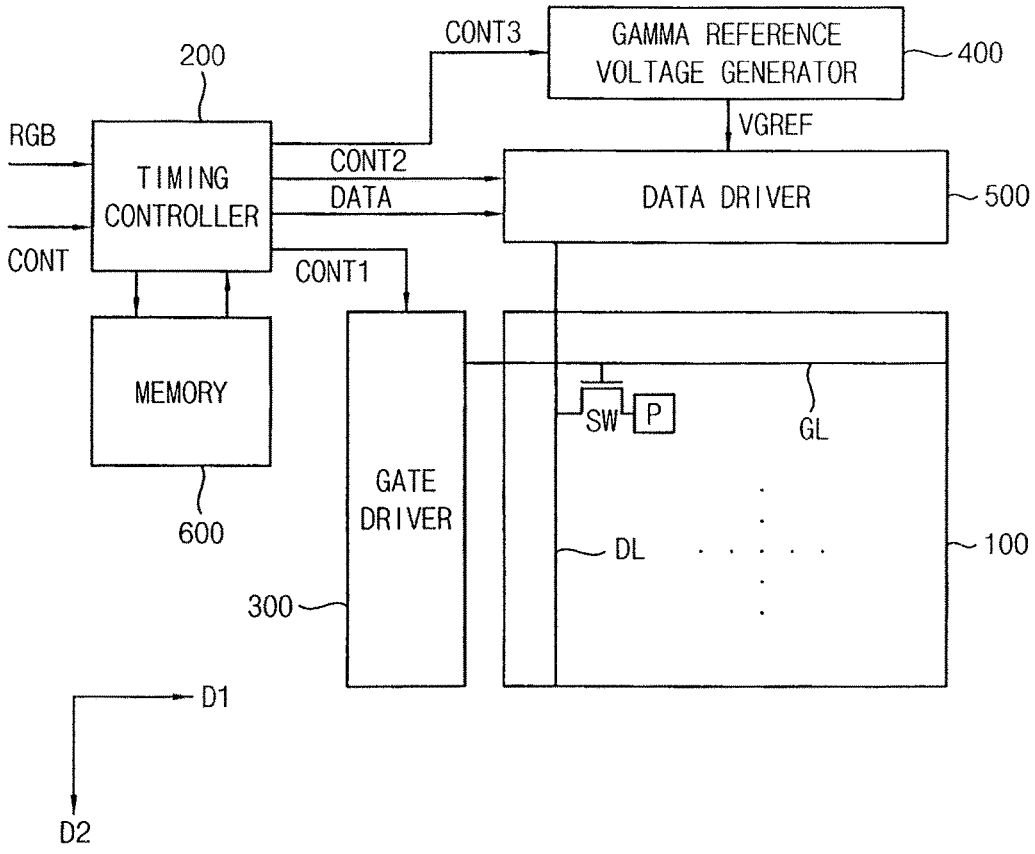
FIG. 1 illustrates an embodiment of a display apparatus.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of a display apparatus which includes a display panel 100 and a display panel driver. The display panel driver includes a timing controller 200, a gate driver 300, a gamma reference voltage generator 400, and a data driver 500. The display panel 100 includes a display region for displaying images based on image data and a peripheral region adjacent to the display region.

The display panel 100 includes a plurality of gate lines GL, a plurality of data lines DL, and a plurality of subpixels P connected to the gate lines GL and data lines DL. The gate lines GL extend in a first direction D1 and the data lines DL extend in a second direction D2 crossing the first direction D1. Each subpixel P includes a capacitor electrically connected to a switching element SW. The subpixels P may be disposed in a matrix form and the switching element SW may be, for example, a thin film transistor. The display apparatus may be, for example, a liquid crystal display apparatus, an organic light emitting diode display apparatus, or another type of display apparatus.

The timing controller 200 receives the input image data RGB and an input control signal CONT from an external apparatus. The input image data may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT. The timing controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

When the same grayscale value of a subpixel P is repetitive, the timing controller 200 accumulates a count value of the subpixel P. The timing controller 200 determines a boundary portion of an image using the accumulated count values of the subpixels P. The timing controller 200 generates the data signal DATA to compensate the boundary portion of the image.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 from the timing controller 200. The gate driver 300 sequentially outputs the gate signals to the gate lines GL. The gate driver 300 may be integrated on the peripheral portion of the display panel 100. In another embodiment, the gate driver 300 may be directly mounted on the display panel 100 or may be connected to the display panel 100 as a tape carrier package (TCP) type.

The gamma reference voltage generator 400 generates a gamma reference voltage VGREF in response to the third control signal CONT3 from the timing controller 200. The gamma reference voltage generator 400 provides the gamma reference voltage VGREF to the data driver 500. The gamma reference voltage VGREF has a value corresponding to a level of the data signal DATA. The gamma reference voltage generator 400 may be, for example, in the timing controller 200 or the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA to data voltages having an analog type using the gamma reference voltages VGREF. The data driver 500 outputs the data voltages to the data lines DL. The data driver 500 may be directly mounted on the display panel 100 or may be connected to the display panel 100 in a TCP type. In one embodiment, the data driver 500 may be integrated on the display panel 100.

The display apparatus may further include a memory 600 having an image buffer, count buffer, and a compensating buffer. The image buffer stores previous frame data of the input image data RGB, the count buffer stores a count value, and the compensating buffer stores a boundary compensating value to compensate a boundary portion of the image.

Figure 2:
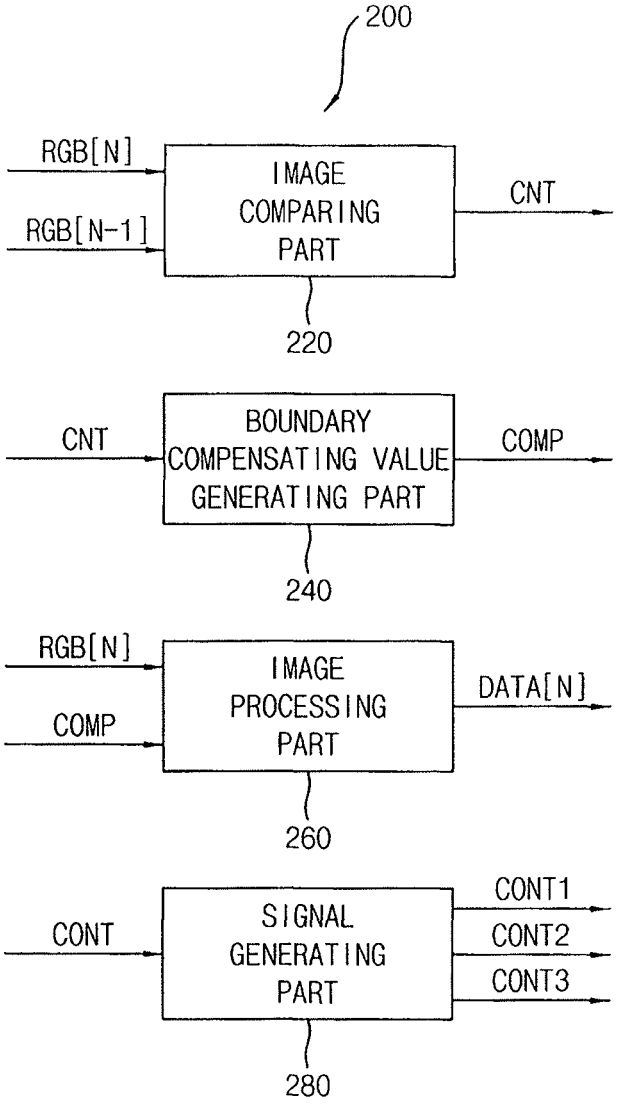
FIG. 2 illustrates an embodiment of a timing controller.

FIG. 2 illustrates an embodiment of the timing controller 200. FIG. 3 illustrates an embodiment of the image buffer 610 of the memory 600. FIG. 4 illustrates an embodiment of the count buffer 620 of the memory 600. FIG. 5 illustrates an embodiment of the compensating buffer 630 of the memory 600.

Referring to FIGS. 1 to 5, the timing controller 200 includes an image comparing part 220, a boundary compensating value generating part 240, an image processing part 260, and a signal generating part 280. The image comparing part 220 compares present frame data of the input image data RGB directly input to the timing controller 200 to previous frame data of the input image data RGB stored in the image buffer 610.

The image buffer 610 stores the previous frame data in units of subpixels. Although the image buffer 610 in FIG. 3 is illustrated to have storage spaces corresponding to nine rows and fifteen columns R11 to R59, G11 to G59, and B11 to B59, the image buffer 610 may have a different number of storage spaces in another embodiment, e.g., a number corresponding to the number of all the subpixels P. The image buffer 610 may be a full-frame buffer or may be less than a full-frame buffer, e.g., a half frame buffer.

The image comparing part 220 compares the present frame data to previous frame data in units of subpixels P, and determines whether the same grayscale value is repetitive or not at each of the subpixels P. When the same grayscale value of the subpixel P is repetitive, the image comparing part 220 accumulates a count value CNT of the subpixel P in the count buffer 620. If the time duration when the same grayscale value is repetitive is long (e.g., greater than a predetermined value), the count value CNT may be large. When the repetitive grayscale value is large, the count value CNT may also be large.

The count buffer 620 accumulates the count value CNT in units of subpixels. Although the count buffer 620 in FIG. 4 has storage spaces corresponding to nine rows and fifteen columns RN11 to RN59, GN11 to GN59 and BN11 to BN59, the count buffer 620 may have a different number of storage spaces, e.g., a number corresponding to the number of all the subpixels P.

For example, when the grayscale value of 255 is repetitive in a reference time at the subpixel P, the count value of the subpixel P may increase by one. When the grayscale value of 255 is repetitive twice in the reference time at the subpixel P, the count value of the subpixel P may increase by two. When the grayscale value of 127 is repetitive twice in the reference time at the subpixel P, the count value of the subpixel P may increase by one. The increment values by which the count values are increased may be different in other embodiments.

The count value CNT may be determined, for example, based on the product of time and the grayscale value. In another embodiment, the count value CNT may be determined based on the product of time, the grayscale value, and an offset value. The offset value may vary according to the grayscale value. Accordingly, the count value CNT according to the grayscale value may form a logarithmic function or an exponential function.

The boundary compensating value generating part 240 receives the count value CNT from the count buffer 620. When the grayscale value of the subpixel P stops repeating, the boundary compensating value generating part 240 may receive the count value CNT accumulated in the count buffer 620. The boundary compensating value generating part 240 may operate independently from each subpixel. The boundary compensating value generating part 240 may determine a group of the subpixels (first region) at which the grayscale values are not repetitive.

The boundary compensating value generating part 240 determines a boundary portion of an image in the first region where the grayscale values are not repetitive using the count value CNT. The boundary compensating value generating part 240 may determine the boundary portion of the image independently according to colors of the subpixels. For example, the boundary compensating value generating part 240 may determine the boundary portion of a red image by comparing the count values of adjacent red subpixels. The boundary compensating value generating part 240 may determine the boundary portion of a green image by comparing the count values of adjacent green subpixels. The boundary compensating value generating part 240 may determine the boundary portion of a blue image by comparing the count values of adjacent blue subpixels.

The boundary compensating value generating part 240 generates a boundary compensating value COMP to compensate the boundary portion. The boundary compensating value generating part 240 outputs the boundary compensating value COMP to the compensating buffer 630.

The compensating buffer 630 stores the boundary compensating value COMP in units of subpixels. Although the compensating buffer 630 in FIG. 3 has storage spaces corresponding to nine rows and fifteen columns RC11 to RC59, GC11 to GC59 and BC11 to BC59, the compensating buffer 630 may have a different number of storage spaces in another embodiment, e.g., a number corresponding to the number of all the subpixels P.

The accumulated count value CNT defines the time duration to compensate the boundary portion. When the accumulated count value CNT is large (e.g., greater than as predetermined value), the time duration to compensate the boundary portion is large. For example, when the accumulated count value CNT is five, the boundary compensating value COMP is output to the compensating buffer 630 during five frames to compensate the boundary portion of the image during five frames.

When the count value CNT increases to a maximum count value, the count value CNT may not be increased over the maximum count value, even though the same grayscale value is repetitive at the subpixel. The temporary image retention due to the hysteresis may not be efficiently reduced when the compensation time exceeds a preset time (corresponding to the maximum count value).

The boundary compensating value generating part 240 generates the boundary compensating value COMP independently according to colors of the subpixels. For example, the boundary compensating value generating part 240 outputs a red boundary compensating value to compensate the boundary portion of the red image to a red buffer part of the compensating buffer 630. The boundary compensating value generating part 240 outputs a green boundary compensating value to compensate the boundary portion of the green image to a green buffer part of the compensating buffer 630. The boundary compensating value generating part 240 outputs a blue boundary compensating value to compensate the boundary portion of the blue image to a blue buffer part of the compensating buffer 630.

The boundary compensating value COMP forms a compensating pattern. The compensating pattern may correspond to a sequence of the boundary compensating values COMP stored in the compensating buffer. The compensating pattern may have boundary compensating values COMP that are symmetrical with respect to the boundary portion. When the boundary portion extends in a first (e.g., vertical) direction, a left side of the boundary portion and a right side of the boundary portion may have boundary compensating values COMP symmetrical with each other in a second (e.g., horizontal) direction. When the boundary portion extends in the second direction, an upper side of the boundary portion and a lower side of the boundary portion may have the boundary compensating values COMP that are symmetrical with each other in the first direction.

The boundary compensating value COMP may be set as an increment or decrement of the grayscale value. For example, if the boundary compensating value COMP of the subpixel P is two and the grayscale value of the input image data corresponding to the subpixel P is 105, the data signal of the subpixel P is generated based on the grayscale value of 107.

The image processing part 260 compensates the grayscale value of the present frame data of the input image data RGB and rearranges the input image data RGB to generate the data signal DATA to correspond to a data type of the data driver 500. The image processing part 260 may compensate the grayscale value of the present frame data using the boundary compensating value COMP of the input image data RGB.

The image processing part 260 may further operate to perform adaptive color correction ("ACC") and a dynamic capacitance compensation ("DCC"), in addition to the above mentioned boundary compensation.

The image processing part 260 outputs the data signal DATA to the data driver 500. The data signal DATA may be, for example, digital data.

The signal generating part 280 receives the input control signal CONT and generates the first control signal CONT1 for controlling driving timing of the gate driver 300 and the second control signal CONT2 for controlling driving timing of the data driver 500. The signal generating part 280 generates the third control signal CONT3 for controlling driving timing of the gamma reference voltage generator 400. The signal generating part 280 outputs the first control signal CONT1 to the gate driver 300, the second control signal CONT2 to the data driver 500, and the third control signal CONT3 to the gamma reference voltage generator 400.

FIG. 6A is a conceptual diagram illustrating a case when a stripe pattern of a maximum grayscale value and a minimum grayscale value is input to the image buffer 610 of FIG. 3. FIG. 6B is a conceptual diagram illustrating a case when a single color pattern of a middle grayscale value is input to the image buffer 610 of FIG. 3. FIG. 7 is a conceptual diagram illustrating the count buffer 620 including accumulated count values for the input image of FIGS. 6A and 6B. FIG. 8 is a conceptual diagram illustrating the compensating buffer 630 including compensating value determined by the count value 620 accumulated at the count buffer of FIG. 7.

Referring to FIGS. 6A to 8, operations of the timing controller 200, the image buffer 610, the count buffer 620, and the compensating buffer 630 are explained. The boundary compensating of the timing controller 200 may be operated independently according to colors of light to be emitted by the subpixels. Only red portions of the image buffer 610, the count buffer 620, and the compensating buffer 630 are illustrated in FIGS. 6A to 8 for convenience of explanation.

In FIG. 6A, the stripe pattern of the maximum grayscale value and the minimum grayscale value is continuously input to the timing controller 200. When the stripe pattern is input to the timing controller 200, the stripe pattern is also input to the image buffer 610. The minimum grayscale value (e.g. zero) is input to first to fifth red subpixel columns RI to R5 of the image buffer 610. The maximum grayscale value (e.g., 255) is input to sixth to tenth red subpixel columns R6 to R10 of the image buffer 610. The minimum grayscale value is input to eleventh to fifteenth red subpixel columns R11 to R15 of the image buffer 610.

When the stripe pattern is continuously input to the timing controller, the count values are continuously accumulated at the sixth to tenth red subpixel columns RN6 to RN10 of the count buffer 620, corresponding to the sixth to tenth red subpixel columns R6 to R10 of the image buffer 610 where the maximum grayscale values are input.

In FIG. 6B, the single color pattern of a middle grayscale value is continuously input to the timing controller 200 after the stripe pattern of FIG. 6A is input. When the input image data RGB input to the timing controller 200 is changed, the boundary compensating value generating part 240 of the timing controller 200 determines the boundary portion of the image based on the accumulated count value CNT and generates the boundary compensating value COMP to compensate the boundary portion.

In the example of FIG. 7, the count values CNT of the first to fifth red subpixel columns RN1 to RN5 of the count buffer 620 are all zero, the count values CNT of the sixth to tenth red subpixel columns RN6 to RN10 of the count buffer 620 are all five, and the count values CNT of the eleventh to fifteenth red subpixel columns RN11 to RN15 of the count buffer 620 are all zero. The boundary compensating value generating part 240 determines the boundary between the fifth red subpixel column RN5 and the sixth red subpixel column RN6 as a first boundary portion. The boundary compensating value generating part 240 determines a boundary between the tenth red subpixel column RN10 and the eleventh red subpixel column RN11 as a second boundary portion.

The boundary compensating value generating part 240 outputs the boundary compensating values to portions of the compensating buffer 630 corresponding to the boundary portion of the image. In the present exemplary embodiment, the compensating pattern of the compensating values may have a sequence of 1, 2, 2, 1 at the left and right side of the boundary portion. The compensating pattern may be symmetrical with respect to the boundary portion.

When the compensating pattern is applied to an area corresponding to the boundary portion of the image, the boundary of the image is blurred and thus may not be clearly shown to a user. The temporary image retention due to the hysteresis of the switching element SW may therefore be compensated.

In the aforementioned example, the compensating pattern has a sequence of 1, 2, 2, 1. The compensating pattern may have a different sequence in another embodiment. For example, the compensating pattern may have a sequence of 2, 4, 4, 2, a sequence of 2, 1, 1, 2, and/or a sequence of 1, 1, 2, 2, 2, 2, 1, 1.

When the boundary compensating value to compensate the boundary portion of the first region is written in the compensating buffer 630 based on the accumulated count value CNT, a portion of the count buffer 620 corresponding to the first region may be reset. The boundary compensating value in the compensating buffer 630 may last during the time corresponding to the count value CNT.

After the count buffer 620 is reset, the image comparing part 220 compares the present frame data to the previous frame data. When the same grayscale value is repetitive during the previous frame and the present frame, the count value is accumulated at the count buffer 620 again.

Figure 9:
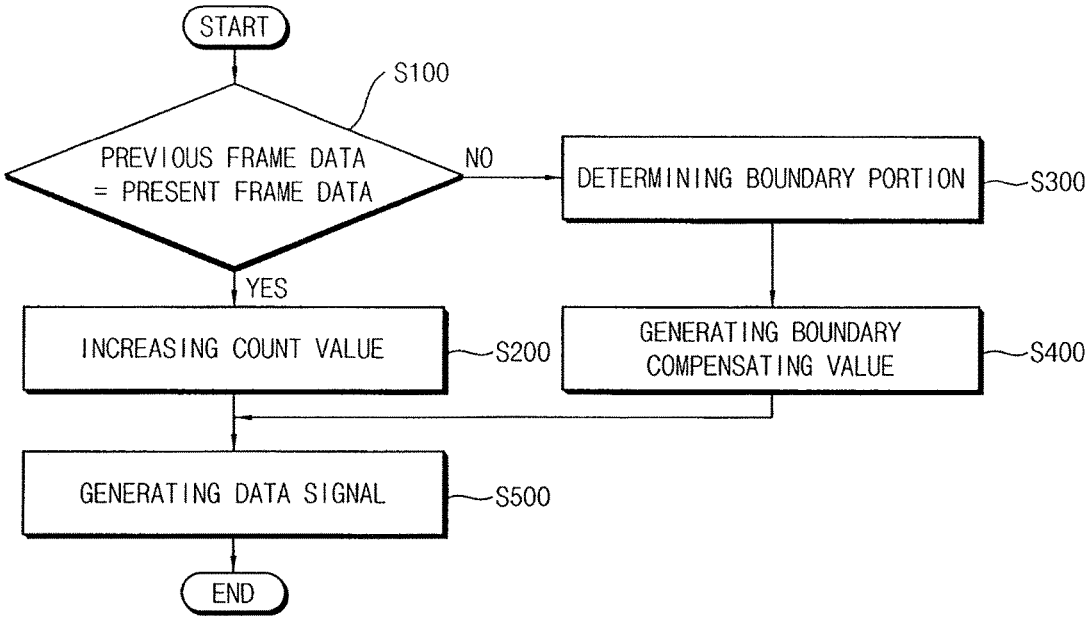
FIG. 9 illustrates an embodiment of a method for driving a display panel.

FIG. 9 illustrates an embodiment of a method of the display panel 100 for a display apparatus such as illustrated in FIG. 1. Referring to FIGS. 1 to 9, the image comparing part 220 of the timing controller 200 compares present frame data of the input image data RGB directly input to the timing controller 200 to previous frame data of the input image data RGB stored in the image buffer 610 (operation S100).

The image comparing part 220 determines whether the same grayscale value is repetitive or not at each of the subpixels P. When the same grayscale value of the subpixel P is repetitive, the image comparing part 220 accumulates the count value CNT of the subpixel P in the count buffer 620 (operation S200). If time duration when the same grayscale value is repetitive is long (e.g., greater than a predetermined value), the count value CNT may be large. When the repetitive grayscale value is large, the count value CNT may be great.

The image comparing part 220 increases the count value CNT at every frame. In another embodiment, the image comparing part 220 may increase the count value CNT if the repeating time of the same grayscale exceeds a threshold number of frames. For example, when a driving frame of the display panel is 60 Hz and the repeating time is set to one minute, the threshold number of frames may be 3,600.

When the grayscale value of the subpixel P stops repeating, the boundary compensating value generating part 240 determines a boundary portion of an image in the first region where the grayscale values are not repetitive using the count value CNT accumulated at the count buffer 620 (operation S300).

The boundary compensating value generating part 240 generates a boundary compensating value COMP to compensate the boundary portion (operation S400). The boundary compensating value generating part 240 outputs the boundary compensating value COMP to the compensating buffer 630.

The image processing part 260 compensates the grayscale value of present frame data of the input image data RGB and rearranges the input image data RGB to generate the data signal DATA corresponding to the type of data of the data driver 500 (operation S500).

The image processing part 260 compensates the grayscale value of the present frame data using the boundary compensating value COMP of the input image data RGB.

According to the present exemplary embodiment, when the same grayscale value of the subpixel P is repetitive, the timing controller 200 accumulates a count value of the subpixel P. The timing controller 200 determines a boundary portion of an image using the accumulated count values of the subpixels P. The timing controller 200 generates the data signal DATA to compensate the boundary portion of the image. Thus, the temporary image retention due to the switching element SW of the display panel 100 may be reduced, so that the display quality of the display panel 100 may be improved.

FIG. 10A is a conceptual diagram illustrating an example of the contents of a compensating buffer in an N-th frame. FIG. 10B is a conceptual diagram illustrating the contents of the compensating buffer of FIG. 10A in an (N+1)-th frame. The display apparatus and the method of driving the display panel according to the present exemplary embodiment may be substantially the same as the display apparatus and the method of driving the display panel of the embodiment explained with reference to FIGS. 1 to 9, except for the boundary compensating values.

Referring to FIGS. 1 to 7, 10A, and 10B, the display apparatus includes a display panel 100 and a display panel driver. The display panel driver includes a timing controller 200, a gate driver 300, a gamma reference voltage generator 400 and a data driver 500. The display apparatus may further include a memory 600.

The timing controller 200 includes an image comparing part 220, a boundary compensating value generating part 240, an image processing part 260 and a signal generating part 280. The image comparing part 220 compares present frame data of the input image data RGB directly input to the timing controller 200 to previous frame data of the input image data RGB stored in the image buffer 610. The image comparing part 220 compares the present frame data to the previous frame data in units of subpixels P. The image comparing part 220 determines whether the same grayscale value is repetitive or not at each of the subpixels P. When the same grayscale value of the subpixel P is repetitive, the image comparing part 220 accumulates the count value CNT of the subpixel P in the count buffer 620.

The boundary compensating value generating part 240 receives the count value CNT from the count buffer 620. When the grayscale value of the subpixel P stops repeating, the boundary compensating value generating part 240 may receive the count value CNT accumulated in the count buffer 620. The boundary compensating value generating part 240 operates independently from each subpixel. The boundary compensating value generating part 240 may determine a group of the subpixels (first region) at which the grayscale values are not repetitive.

The boundary compensating value generating part 240 determines a boundary portion of an image in the first region where the grayscale values are not repetitive using the count value CNT.

The boundary compensating value generating part 240 generates a boundary compensating value COMP to compensate the boundary portion. The boundary compensating value generating part 240 outputs the boundary compensating value COMP to the compensating buffer 630.

The accumulated count value CNT defines time duration to compensate the boundary portion. When the accumulated count value CNT is great, the time duration to compensate the boundary portion is great.

The boundary compensating value COMP may form a compensating pattern. The compensating pattern may correspond to a sequence of the boundary compensating values COMP stored in the compensating buffer. In the compensating pattern, the boundary compensating values COMP may be symmetrical with respect to the boundary portion.

In the present exemplary embodiment, for example, the stripe pattern of the maximum grayscale value and the minimum grayscale value is input to the timing controller 200 as shown in FIG. 6A. The single color pattern of the middle grayscale value is input to the timing controller 200 after the stripe pattern of FIG. 6A is input as shown in FIG. 6B.

The boundary compensating value generating part 240 generates varied compensating patterns for the same boundary portion according to frames. For example, when the boundary portion is generated between the fifth red subpixel column and the sixth red subpixel column, the boundary compensating value generating part 240 may generate the compensating values having a sequence of 1, 2, 2, 1 to fourth to seventh red subpixel column RC4 to RC7 during an N-th frame FRAME[N]. The boundary compensating value generating part 240 may generate the compensating values having a sequence of 2, 1, 1, 2 to the fourth to seventh red subpixel column RC4 to RC7 during an (N+1)-th frame FRAME[N+1]. Additionally, the boundary compensating value generating part 240 may generate the compensating values having a sequence of 1, 2, 2, 1 to the fourth to seventh red subpixel column RC4 to RC7 during an (N+2)-th frame. The boundary compensating value generating part 240 may generate the compensating values having a sequence of 2, 1, 1, 2 to the fourth to seventh red subpixel column RC4 to RC7 during an (N+3)-th frame.

Thus, the boundary compensating value generating part 240 may compensate the boundary portion by a dithering method so that the boundary of the image may be more efficiently compensated.

In the present embodiment, the boundary compensating value generating part 240 repeatedly generates the two different compensating patterns in a cycle of two frames. In another embodiment, the boundary compensating value generating part 240 may repeatedly generate three or more compensating patterns in a cycle of three or more frames.

The image processing part 260 compensates the grayscale value of the present frame data of the input image data RGB and rearranges the input image data RGB to generate the data signal DATA to correspond to a data type of the data driver 500.

The image processing part 260 may compensate the grayscale value of the present frame data using the boundary compensating value COMP of the input image data RGB. The image processing part 260 outputs the data signal DATA to the data driver 500.

According to the present exemplary embodiment, when the same grayscale value of the subpixel P is repetitive, the timing controller 200 accumulates a count value of the subpixel P. The timing controller 200 determines a boundary portion of an image using the accumulated count values of the subpixels P. The timing controller 200 generates the data signal DATA to compensate the boundary portion of the image. Thus, the temporary image retention due to the switching element SW of the display panel 100 may be reduced, so that the display quality of the display panel 100 may be improved.

FIG. 11 is a conceptual diagram illustrating an example of the contents of the compensating buffer 630. The display apparatus and the method of driving the display panel according to the present exemplary embodiment may be substantially the same as the display apparatus and the method of driving the display panel of the embodiment corresponding to FIGS. 1 to 9, except for the boundary compensating values.

Referring to FIGS. 1 to 7 and 11, the display apparatus includes a display panel 100 and a display panel driver. The display panel driver includes a timing controller 200, a gate driver 300, a gamma reference voltage generator 400 and a data driver 500. The display apparatus may further include a memory 600.

The timing controller 200 includes an image comparing part 220, a boundary compensating value generating part 240, an image processing part 260 and a signal generating part 280. The image comparing part 220 compares present frame data of the input image data RGB directly input to the timing controller 200 to previous frame data of the input image data RGB stored in the image buffer 610. The image comparing part 220 compares the present frame data to the previous frame data in a unit of the subpixel P and determines whether the same grayscale value is repetitive or not at each of the subpixels P. When the same grayscale value of the subpixel P is repetitive, the image comparing part 220 accumulates the count value CNT of the subpixel P in the count buffer 620.

The boundary compensating value generating part 240 receives the count value CNT from the count buffer 620. When the grayscale value of the subpixel P stops repeating, the boundary compensating value generating part 240 may receive the count value CNT accumulated in the count buffer 620. The boundary compensating value generating part 240 operates independently from each subpixel. The boundary compensating value generating part 240 may determine a group of the subpixels (first region) at which the grayscale values are not repetitive.

The boundary compensating value generating part 240 determines a boundary portion of an image in the first region where the grayscale values are not repetitive using the count value CNT. The boundary compensating value generating part 240 generates a boundary compensating value COMP to compensate the boundary portion. The boundary compensating value generating part 240 outputs the boundary compensating value COMP to the compensating buffer 630.

The accumulated count value CNT may correspond to the time duration to compensate the boundary portion. When the accumulated count value CNT is great, the time duration to compensate the boundary portion is great.

The boundary compensating value COMP may form a compensating pattern. The compensating pattern may correspond to a sequence of the boundary compensating values COMP stored in the compensating buffer. The compensating pattern may have boundary compensating values COMP that are symmetrical with respect to the boundary portion.

In the present exemplary embodiment, for example, the boundary portion (a first boundary portion in a first moment) is generated between the fifth red subpixel column and the sixth red subpixel column and between the tenth red subpixel column and the eleventh red subpixel column as FIGS. 6A and 6B. For example, the accumulated count value may be 100, the compensating pattern of 1, 2, 2, 1 may be applied to the boundary portion during 100 frames.

If a second boundary portion is generated at a second moment during the time (e.g. 100 frames) when the compensating pattern is applied, the compensation for the first boundary portion and the compensation for the second boundary portion may overlap.

In FIG. 11, for example, a second boundary portion is generated between a fourth red subpixel row and a fifth red subpixel row, the compensating pattern of 1, 2, 2, 1 may be applied to third to sixth red subpixel rows to compensate the second boundary portion.

When the plural compensating values (e.g. first compensating value to compensate the first boundary portion and second compensating value to compensate the second boundary portion) exist at the subpixel of the compensating buffer 630, the compensating values may be summed.

The image processing part 260 compensates the grayscale value of the present frame data of the input image data RGB and rearranges the input image data RGB to generate the data signal DATA to correspond to a data type of the data driver 500. The image processing part 260 compensates the grayscale value of the present frame data using the boundary compensating value COMP of the input image data RGB. The image processing part 260 outputs the data signal DATA to the data driver 500.

According to the present exemplary embodiment, when the same grayscale value of the subpixel P is repetitive, the timing controller 200 accumulates a count value of the subpixel P. The timing controller 200 determines a boundary portion of an image using the accumulated count values of the subpixels P. The timing controller 200 generates the data signal DATA to compensate the boundary portion of the image. Thus, the temporary image retention due to the switching element SW of the display panel 100 may be reduced, so that the display quality of the display panel 100 may be improved.

FIG. 12 is a conceptual diagram illustrating an example of the contents of a compensating buffer 630. The display apparatus and the method of driving the display panel according to the present exemplary embodiment may be substantially the same as the display apparatus and the method of driving the display panel of the embodiment corresponding to FIGS. 1 to 7 and 11, except for the boundary compensating values.

Referring to FIGS. 1 to 7 and 12, the display apparatus includes a display panel 100 and a display panel driver. The display panel driver includes a timing controller 200, a gate driver 300, a gamma reference voltage generator 400, and a data driver 500. The display apparatus may further include a memory 600. The timing controller 200 includes an image comparing part 220, a boundary compensating value generating part 240, an image processing part 260 and a signal generating part 280.

The image comparing part 220 compares present frame data of the input image data RGB directly input to the timing controller 200 to previous frame data of the input image data RGB stored in the image buffer 610. The image comparing part 220 compares the present frame data to the previous frame data in units of subpixels P. The image comparing part 220 determines whether the same grayscale value is repetitive or not at each of the subpixels P. When the same grayscale value of the subpixel P is repetitive, the image comparing part 220 accumulates the count value CNT of the subpixel P to the count buffer 620.

The boundary compensating value generating part 240 receives the count value CNT from the count buffer 620. When the grayscale value of the subpixel P stops repeating, the boundary compensating value generating part 240 may receive the count value CNT accumulated in the count buffer 620. The boundary compensating value generating part 240 operates independently from each subpixel. The boundary compensating value generating part 240 may determine a group of the subpixels (first region) at which the grayscale values are not repetitive.

The boundary compensating value generating part 240 determines a boundary portion of an image in the first region where the grayscale values are not repetitive using the count value CNT. The boundary compensating value generating part 240 generates a boundary compensating value COMP to compensate the boundary portion. The boundary compensating value generating part 240 outputs the boundary compensating value COMP to the compensating buffer 630.

The accumulated count value CNT defines time duration to compensate the boundary portion. When the accumulated count value CNT is great, the time duration to compensate the boundary portion is great.

The boundary compensating value COMP may form a compensating pattern. The compensating pattern may correspond to a sequence of the boundary compensating values COMP stored in the compensating buffer. The compensating pattern may have the boundary compensating values COMP that are symmetrical with respect to the boundary portion.

In the present exemplary embodiment, for example, the boundary portion (a first boundary portion in a first moment) is generated between the fifth red subpixel column and the sixth red subpixel column and between the tenth red subpixel column and the eleventh red subpixel column as FIGS. 6A and 6B. For example, the accumulated count value may be 100 and the compensating pattern of 1, 2, 2, 1 may be applied to the boundary portion during 100 frames.

If a second boundary portion is generated at a second moment during the time (e.g. 100 frames) when the compensating pattern is applied, the compensation for the first boundary portion and the compensation for the second boundary portion may overlap. The boundary compensating value generating part 240 may alternately generate positive boundary compensating values and negative boundary compensating values for the plural boundary portions which are generated at different moments.

In FIG. 12, for example, a second boundary portion is generated between a fourth red subpixel row and a fifth red subpixel row, a compensating pattern may be applied to third to sixth red subpixel rows to compensate the second boundary portion like FIG. 11. In the present exemplary embodiment, the compensating pattern of −1, −2, −2, −1 may be applied to the third to sixth red subpixel rows to compensate the second boundary portion.

When the compensating values (e.g., first compensating value to compensate the first boundary portion and second compensating value to compensate the second boundary portion) exist at the subpixel of the compensating buffer 630, the compensating values may be summed.

When the compensating patterns for the plural boundary portions overlap with each other and the compensating values of the plural compensating patterns have the same polarity, the compensating grayscale value may be relatively great. Thus, the boundary portions may represent a luminance higher than the desired grayscale of the boundary portions.

In the present exemplary embodiment, the first compensating pattern to compensate the first boundary portion has positive compensating values and the second compensating pattern to compensate the second boundary portion has negative compensating values. Accordingly, the luminance of the boundary portion may not increase unnecessarily.

The image processing part 260 compensates the grayscale value of the present frame data of the input image data RGB and rearranges the input image data RGB to generate the data signal DATA to correspond to a data type of the data driver 500. The image processing part 260 may compensate the grayscale value of the present frame data using the boundary compensating value COMP of the input image data RGB. The image processing part 260 outputs the data signal DATA to the data driver 500.

According to the present exemplary embodiment, when the same grayscale value of the subpixel P is repetitive, the timing controller 200 accumulates a count value of the subpixel P. The timing controller 200 determines a boundary portion of an image using the accumulated count values of the subpixels P. The timing controller 200 generates the data signal DATA to compensate the boundary portion of the image. Thus, the temporary image retention due to the switching element SW of the display panel 100 may be reduced, so that the display quality of the display panel 100 may be improved.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The comparing, compensating, and other processing features of the embodiments described herein may be implemented in logic which, for example, may include hardware, software, or both. When implemented at least partially in hardware, the BMS may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the comparing, compensating, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods herein.

By way of summation and review, a display apparatus typically includes a display panel and a display panel driver. The display panel has gate lines and data lines connected to subpixels, and the display panel driver includes a timing controller, a gate driver, and a data driver. The gate driver outputs a gate signal to the gate line, and the data driver outputs data voltages to the data lines. The subpixels emit light with a luminance that is based on the data voltages. Additionally, each subpixel may include a switching element in the form of a thin film transistor. When the thin film transistor repetitively turns on and off, a temporary image retention effect may be generated due to hysteresis. The temporary image retention effect may adversely affect the performance of the display panel.

In accordance with one or more of the aforementioned embodiments, temporary image retention due to the hysteresis of the switching element may be reduced so that the display quality of the display panel may be improved.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A display apparatus, comprising:

a display panel including a plurality of subpixels to display an image;

a timing controller to accumulate count values for a number of the subpixels, each of the count values to be accumulated when a respective one of the number of subpixels has a same repeating grayscale value, determine a boundary portion of the image based on differences between the accumulated count values of the adjacent subpixels, and generate one or more data signals to compensate the boundary portion; and a data driver to convert the one or more data signals to corresponding data voltages for the display panel, wherein all the subpixels of the display panel are driven at a same frame rate, wherein the timing controller is to generate a first compensating pattern having positive boundary compensating values to compensate a first boundary portion and a second compensating pattern having negative boundary compensating values to compensate a second boundary portion.

2. The display apparatus as claimed in claim 1, wherein each of the accumulated count values is to increase as a time duration during which the same respective grayscale value repeats increases.

3. The display apparatus as claimed in claim 1, wherein each of the accumulated count values is to increase as the repetition of the same grayscale value increases.

4. The display apparatus as claimed in claim 1, wherein:

the timing controller is to generate at least one boundary compensating value based on the accumulated count values and to generate the one or more data signals to compensate the first and second boundary portions based on the at least one boundary compensating value, the at least one boundary compensating value is to control a number of frames in which the one or more data signals are to compensate the first and second boundary portions, and the number of frames to compensate the first and second boundary portions is to increase as the accumulated count values used to generate the at least one boundary compensating value increase.

5. The display apparatus as claimed in claim 1, wherein, when one of the accumulated count values increases to a maximum count value, the one of the accumulated count values is not to be increased over the maximum count value, even when the same grayscale value repeats for the respective subpixel.

6. The display apparatus as claimed in claim 1, wherein the timing controller includes an image comparator to compare present frame data to previous frame data.

7. The display apparatus as claimed in claim 6, further comprising:

an image buffer to store the previous frame data in units of subpixels.

8. The display apparatus as claimed in claim 1, further comprising: a count buffer to store the accumulated count values of the number of subpixels.

9. The display apparatus as claimed in claim 8, further comprising: a compensating buffer to store a boundary compensating value to compensate the first and second boundary portions.

10. The display apparatus as claimed in claim 9, wherein, when the boundary compensating value to compensate a boundary portion of a first region of the image is written in the compensating buffer based on the accumulated count values, a portion of the count buffer corresponding to the first region is to be reset.

11. The display apparatus as claimed in claim 9, wherein, when a plurality of compensating values exist at one or more of the subpixels of the compensating buffer, the plurality of compensating values are to be summed.

12. The display apparatus as claimed in claim 1, wherein the timing controller is to generate varied compensating patterns for a same boundary portion on a frame basis.

13. The display apparatus as claimed in claim 1, wherein the boundary portion of the image is to be independently determined based on colors of light to be emitted by the subpixels.

14. A method of driving a display panel, the method comprising:

accumulating count values for a plurality of subpixels of the display panel, each of the count values accumulated when a same grayscale value is repetitive at a respective one of the subpixels;

determining a boundary portion of an image based on differences between the accumulated count values of the adjacent subpixels and generating a boundary compensating value for each of the subpixels to compensate the boundary portion when the same grayscale values of respective ones of the subpixels stop repeating; and generating one or more data voltages based on input image data and the boundary compensating value for each of the subpixels and outputting the one or more data voltages to the display panel, wherein all the subpixels of the display panel are driven at a same frame rate, wherein generating the boundary compensating value for each of the subpixels includes generating a first compensating pattern having positive boundary compensating values to compensate a first boundary portion and generating a second compensating pattern having negative boundary compensating values to compensate a second boundary portion.

15. The method as claimed in claim 14, wherein each of the accumulated count values is to increase as a time duration during which repetition of the same grayscale value increases.

16. The method as claimed in claim 14, wherein each of the accumulated count values increases as the repetition of the same grayscale value increases.

17. The method as claimed in claim 14, wherein:

generating the boundary compensating value for each of the subpixels is based on the accumulated count values, and the method includes controlling a number of frames in which the one or more data voltages are to compensate the first and second boundary portions based on the boundary compensating value, the number of frames to compensate the first and second boundary portions increases as the accumulated count values increase.

18. The method as claimed in claim 14, wherein generating the boundary compensating value for each of the subpixels includes generating varied compensating patterns for a same boundary portion on a frame basis.

* * * * *